US006629830B2

(12) United States Patent
Takahashi et al.

(10) Patent No.: US 6,629,830 B2
(45) Date of Patent: Oct. 7, 2003

(54) PRESSURE ADJUSTER VALVE AND GAS COMPRESSOR USING THE SAME

(75) Inventors: Toru Takahashi, Chiba (JP); Yasuhide Kumakura, Chiba (JP); Muneaki Osada, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/910,106

(22) Filed: Jul. 20, 2001

(65) Prior Publication Data

US 2002/0041817 A1 Apr. 11, 2002

(30) Foreign Application Priority Data

Oct. 5, 2000 (JP) ..... 2000-305871

(51) Int. Cl.[7] ..... F04C 18/00
(52) U.S. Cl. ..... 418/268; 418/270; 137/540
(58) Field of Search ..... 418/268, 270; 137/540, 516.29, 533.15, 539, 514, 517

(56) References Cited

U.S. PATENT DOCUMENTS 1,443,675 A * 1/1923 Bowler ..... 137/540
2,581,478 A * 1/1952 Gaddoni ..... 137/540
2,755,816 A * 7/1956 Collins ..... 137/533.17
3,009,476 A * 11/1961 Usab ..... 137/516.29
3,580,275 A * 5/1971 Hanson et al. ..... 137/540
3,620,653 A 11/1971 Gaylord et al.
4,030,520 A * 6/1977 Sands ..... 137/513.5
4,228,821 A 10/1980 Stark
4,345,886 A * 8/1982 Nakayama et al. ..... 418/248
5,297,579 A 3/1994 McConnell et al.
5,299,598 A * 4/1994 Quartana et al. ..... 137/540
6,105,610 A 8/2000 Watkins, II et al.

FOREIGN PATENT DOCUMENTS

JP 60164690 A * 8/1985 ..... F04C/18/344
JP 61118583 A * 6/1986 ..... F04C/18/344
JP 61241488 A * 10/1986 ..... F04C/29/00

* cited by examiner

*Primary Examiner*—Thomas Denion
*Assistant Examiner*—Theresa Trieu
(74) *Attorney, Agent, or Firm*—Adama & Wilks

(57) ABSTRACT

A pressure adjuster valve has a body having a communication passage for connecting a first chamber in fluid communication with a second chamber and a truncated conical-shaped valve seat portion disposed at one end of the communication passage. A valve element is disposed within the communication passage for undergoing movement therein to engage the valve seat portion of the body. A biasing member normally biases the valve element in a direction away from the valve seat portion.

7 Claims, 7 Drawing Sheets

CLOSING OPERATIONAL CONDITION

OPENING OPERATIONAL CONDITION

PRESSURE ADJUSTER VALVE AND GAS COMPRESSOR USING THE SAME

BACKGROUND OF THE INVENTION

1. Field of the Invention

The present invention relates to pressure adjuster valves, and more particularly to a pressure adjuster valve in which when chamber pressures within the two chambers are reversed, the chamber pressures may be quickly and positively caused to be equal to each other. The present invention also relates to a gas compressor utilizing the pressure adjuster valve.

2. Description of the Related Art

FIG. 6 shows a gas compressor for an automotive air conditioning system. In the same drawing, the gas compressor incorporates therein a pressure adjuster valve 50 as means for preventing the reverse phenomenon of chamber pressures between a suction chamber 11 and a back pressure chamber 23.

That is, in case of the gas compressor shown in FIG. 6, since, upon the operation thereof, the low pressure refrigerant gas within the suction chamber 11 is compressed with in a cylinder 1 and discharged to the side of a discharge chamber 19 as high pressure refrigerant gas, comparing the suction chamber 11 and the back pressure chamber 23, the suction chamber 11 is lower in chamber pressure than the other chamber. However, in the case where a vehicle is parked for a long period of time at a standstill state in particular under the sunshine in high summer and the like, since the refrigerant gas is soluble in the oil within an evaporator constituting the air conditioning system, the refrigerant gas contained in the oil is warmed by an external air kept at a high temperature and gasified and introduced into the suction chamber 11 side of the gas compressor and the like, under the standstill state before starting the gas compressor, the phenomenon that the chamber pressure within the suction chamber 11 is higher than the chamber pressure within the back pressure chamber 23, i.e., the so-called reverse phenomenon would occur.

Moreover, in case of a vane rotary type gas compressor as shown in FIG. 7, the compression of refrigerant gas is performed by the volume change of a compression chamber 10 inside the cylinder 1. Also, the pressure of refrigerant gas to be sucked into the cylinder 1 from the suction chamber 11 is applied to work on the tip ends of vanes 9 forming and partitioning the compression chamber 10.

Accordingly, in accordance with the gas compressor with the structure shown in FIG. 6, under the standstill state before the start of the operation, the pressures of the suction chamber 11 and the back pressure chamber 23 are reversed as described above. For this reason, the vanes 9 are pressed back to vane grooves 8 of a rotor 4 by means of the pressure of refrigerant gas within the suction chamber 11. Therefore, upon the start of the operation, the sealability of the compression chamber 10 partitioned and formed by the vanes 9 and the like is lost, and the compression function of refrigerant gas by the volume change of the compression chamber 10 is degraded, disadvantageously.

Therefore, in the gas compressor shown in FIG. 6, the discharge chamber 19 and the back pressure chamber 23 are in communication with each other through an oil feed passage composed of an oil hole 21, clearances of bearings 5 and 6 and the like. Accordingly, the pressure adjuster valve 50 is provided between the back pressure chamber 23 and the suction chamber 11 as shown in FIG. 8 so that the reverse phenomenon of the chamber pressures between the back pressure chamber 23 and the suction chamber 11 is prevented.

In case of the pressure adjuster valve 50 shown in FIG. 8, when the chamber pressure of the suction chamber 11 is lower than the chamber pressure of the back pressure chamber 23, a valve body 55 is pressed into a truncated conical hole 52 by means of the pressure difference between the two chambers 11 and 23 to close a communication passage 51. On the other hand, when the chamber pressures of the two chambers 11 and 23 are reversed, the valve body 55 is released and moved away from the truncated conical hole 52 by means of the pressure difference of the two chambers 11 and 23. Thus, the pressure of the suction chamber 11 is released to the side of the back pressure chamber 23 through the communication passage 51 and the chamber pressure of the suction chamber 11 is caused to be equal to the chamber pressure of the back pressure chamber 23.

However, in accordance with the pressure adjuster valve 50 with the conventional structure shown in FIG. 8, a gap portion 57 between an edge portion of the truncated conical hole 52 and a surface facing the edge portion is present and the valve body 55 that has been rolled and dropped from the truncated conical hole 52 is partially engaged with this gap portion 57. Accordingly, even if the chamber pressure of the back pressure chamber 23 is higher than the chamber pressure of the suction chamber 11, the valve body 55 hardly would be returned in the direction toward the truncated conical hole 52. Thus, there is a problem that a smooth opening/closing operation of the communication passage 51 could not be ensured.

In order to solve the above-described problem of the pressure adjuster valve 50 shown in FIG. 8, there has been an approach that a front portion from the truncated conical hole 52 is formed to extend in the form of a cylinder as the means for eliminating the gap portion 57. However, in the structure according to this approach, in the case where the oil for lubricating the compressor for lubrication during the operation of the compressor is left within the communication passage 51 even after the standstill of the compressor, an oil film is formed around the valve body 55 so that the valve body 55 is kept stuck to the truncated conical hole 52 by this oil film, or even if the valve body 55 is separated away from the truncated conical hole 52, in some cases, the communication passage 51 is closed by means of the oil film and the normal function of the pressure adjuster valve 50 is lost. For this reason, even if such a reverse phenomenon of the chamber pressure would take place, it is impossible to immediately cause the pressures to be equal, resulting in the problem of such a reverse phenomenon of the chamber pressures, i.e., the degradation in refrigerant gas compression function during the operation of the compressor.

SUMMARY OF THE INVENTION

In order to solve the above-described problems, an object of the present invention is to provide a pressure adjuster valve that may quickly cause the chamber pressures of the two chambers to be equal to each other with high reliability, when the chamber pressures of the two chambers are reversed, and to provide a gas compressor utilizing the pressure adjuster valve.

In order to achieve the above-mentioned objects, according to the present invention, there is provided a pressure adjuster valve having a communication passage for connecting two chambers, a truncated conical hole provided as a valve seat portion on the way of the communication passage, and a valve body provided to be movable within the communication passage and formed to be engageable with the truncated conical hole, characterized in that:

wherein when a chamber pressure within one of the chambers is lower than a chamber pressure of the other chamber, the valve body is depressed into the truncated conical hole by means of a pressure difference between the two chambers to thereby close the communication passage whereas the chamber pressures of the two chambers are reversed, the valve body is released and moved away from the truncated conical hole by means of the pressure difference between the two chambers upon the reversal to thereby open the communication passage;

the pressure adjuster valve comprises a broadening means for partially broadening a width of a fine gap between the valve body and the communication passage.

According to the present invention, there is provided a pressure adjuster valve having a communication passage for connecting two chambers, a truncated conical hole provided as a valve seat portion on the way of the communication passage, and a valve body provided to be movable within the communication passage and formed to be engageable with the truncated conical hole, characterized in that:

wherein when a chamber pressure within one of the chambers is lower than a chamber pressure of the other chamber, the valve body is depressed into the truncated conical hole by means of a pressure difference between the two chambers to thereby close the communication passage whereas the chamber pressures of the two chambers are reversed the valve body is released and moved away from the truncated conical hole by means of the pressure difference between the two chambers upon the reversal to thereby open the communication passage;

the pressure adjuster valve comprises a biasing means for normally biasing the valve body in a direction away from the truncated conical hole.

According to the present invention, there is provided a pressure adjuster valve having a communication passage for connecting two chambers, a truncated conical hole provided as a valve seat portion on the way of the communication passage, and a valve body provided to be movable within the communication passage and formed to be engageable with the truncated conical hole, characterized in that:

wherein when a chamber pressure within one of the chambers is lower than a chamber pressure of the other chamber, the valve body is depressed into the truncated conical hole by means of a pressure difference between the two chambers to thereby close the communication passage, whereas the chamber pressures of the two chambers are reversed, the valve body is released and moved away from the truncated conical hole by means of the pressure difference between the two chambers upon the reversal to thereby open the communication passage, the pressure adjuster valve comprises a biasing means for normally biasing the valve body in a direction away from the truncated conical hole in addition to a broadening means for partially broadening a width of a fine gap between the valve body and the communication passage.

The pressure adjuster valve according to the present invention is characterized in that the broadening means broadens an upper portion of the overall fine gap.

The pressure adjuster valve according to the present invention is characterized in that the broadening means is a means for broadening widths at several positions of the fine gap.

The pressure adjuster valve according to the present invention is characterized in that the broadening means is composed of a groove formed in an inner wall of the communication passage along a moving direction of the valve body.

The pressure adjuster valve according to the present invention is characterized in that the broadening means is composed of a groove formed in an outer circumferential surface of the valve body.

The pressure adjuster valve according to the present invention is characterized in that the biasing force of the biasing means is greater than a bonding force of oil film for bonding the valve body to the truncated conical hole.

According to the present invention, there is provided a gas compressor comprising a cylinder disposed between a pair of side blocks, a rotor laterally rotatably supported inside of the cylinder through bearings provided on the pair of side blocks and a rotor shaft supported by the bearings, vanes provided to be projectable and retractable from an outer circumferential surface of the rotor toward an inner wall of the cylinder, a compression chamber formed and partitioned by the cylinder, the side blocks, the rotor and the vane, repeating changes in magnitude of volume in accordance with a rotation of the rotor and sucking and compressing refrigerant gas within a suction chamber to thereby discharge the medium to the side of a discharge chamber due to the volume change, a flow path of oil for pressurizing and feeding the oil to the side of a back pressure chamber in communication with bottom portions of the vanes through a bearing clearance of the side blocks from an oil sump of a bottom portion of the discharge chamber, and a pressure adjuster valve for causing both the pressures of the suction pressure and the back pressure chamber pressure of the refrigerant gas to be equal to each other when the suction pressure and the back pressure chamber pressure are reversed, characterized in that:

wherein the pressure adjuster valve comprises a communication passage for connecting the suction chamber and back pressure chamber, a truncated conical hole provided as a valve seat portion on the way of the communication passage, a valve body provided to be movable within the communication passage and formed to be engageable with the truncated conical hole, and a broadening means for partially broadening a width of a fine gap between the valve body and the communication passage;

when a chamber pressure within the suction chamber is lower than a chamber pressure of the back pressure chamber, the valve body is pressed into the truncated conical hole by means of a pressure difference between the two chambers to thereby close the communication passage, whereas the chamber pressures of the two chambers are reversed, the valve body is released and moved away from the truncated conical hole by means of the pressure difference between the two chambers upon the reversal to thereby open the communication passage.

According to the present invention, there is provided a gas compressor comprising a cylinder disposed between a pair of side blocks, a rotor laterally rotatably supported inside of the cylinder through bearings provided on the pair of side blocks and a rotor shaft supported by the bearings, vanes provided to be projectable and retractable from the outer circumferential surface of the rotor toward an inner wall of the cylinder, a compression chamber formed and partitioned by the cylinder, the side blocks, the rotor and the vane, repeating changes in magnitude of volume in accordance with a rotation of the rotor and sucking and compressing refrigerant gas within a suction chamber to thereby discharge the medium to the side of a discharge chamber due to the volume change, a flow path of oil for pressurizing and feeding the oil to the side of a back pressure chamber in communication with bottom portions of the vanes through a bearing clearance of the side blocks from an oil sump of a bottom portion of the discharge chamber, and a pressure adjuster valve for causing both the pressures of the suction pressure and the back pressure chamber pressure of the refrigerant gas to be equal to each other when the suction pressure and the back pressure chamber pressure are reversed, wherein the pressure adjuster valve comprises a communication passage for connecting the suction chamber and back pressure chamber, a truncated conical hole provided as a valve seat portion on the way of the communication passage, a valve body provided to be movable within the communication passage and formed to be engageable with the truncated conical hole, and a biasing means for normally biasing the valve body in ad direction away from the truncated conical hole;

when a chamber pressure within the suction chamber is lower than a chamber pressure of the back pressure chamber, the valve body is pressed into the truncated conical hole by means of a pressure difference between the two chambers to thereby close the communication passage against a biasing force of the biasing means, whereas the chamber pressures of the two chambers are reversed, the valve body is released and moved away from the truncated conical hole by means of the pressure difference between the two chambers and the biasing force of the biasing means upon the reversal to thereby open the communication passage.

According to the present invention, there is provided a gas compressor comprising a cylinder disposed between a pair of side blocks, a rotor laterally rotatably supported inside of the cylinder through bearings provided on the pair of side blocks and a rotor shaft supported by the bearings, vanes provided to be projectable and retractable from the outer circumferential surface of the rotor toward an inner wall of the cylinder, a compression chamber formed and partitioned by the cylinder, the side blocks, the rotor and the vane, repeating changes in magnitude of volume in accordance with a rotation of the rotor and sucking and compressing refrigerant gas within a suction chamber to thereby discharge the medium to the side of a discharge chamber due to the volume change, a flow path of oil for pressurizing and feeding the oil to the side of a back pressure chamber in communication with bottom portions of the vanes through a bearing clearance of the side blocks from an oil sump of a bottom portion of the discharge chamber, and a pressure adjuster valve for causing both the pressures of the suction pressure and the back pressure chamber pressure of the refrigerant gas to be equal to each other when the suction pressure and the back pressure chamber pressure are reversed;

wherein the pressure adjuster valve comprises a communication passage for connecting the suction chamber and back pressure chamber, a truncated conical hole provided as a valve seat portion on the way of the communication passage, a valve body provided to be movable within the communication passage and formed to be engageable with the truncated conical hole, a broadening means for partially broadening a width of a fine gap between the valve body and the communication passage, and a biasing means for normally biasing the valve body in ad direction away from the truncated conical hole;

when a chamber pressure within the suction chamber is lower than a chamber pressure of the back pressure chamber, the valve body is pressed into the truncated conical hole by means of a pressure difference between the two chambers to thereby close the communication passage against a biasing force of the biasing means, whereas the chamber pressures of the two chambers are reversed, the valve body is released and moved away from the truncated conical hole by means of the pressure difference between the two chambers and the biasing force of the biasing means upon the reversal to thereby open the communication passage.

The gas compressor according to the present invention is characterized in that the broadening means broadens an upper portion of the overall fine gap.

The gas compressor according to the present invention is characterized in that the broadening means is a means for broadening widths at several positions of the fine gap.

The gas compressor according to the present invention is characterized in that the broadening means is composed of a groove formed in an inner wall of the communication passage along a moving direction of the valve body.

The gas compressor according to the present invention is characterized in that the broadening means is composed of a groove formed in an outer circumferential surface of the valve body.

The gas compressor according to the present invention is characterized in that the biasing force of the biasing means is greater than a bonding force of oil film for bonding the valve body to the truncated conical hole.

In the gas compressor having the broadening means according to the present invention, the continuity of the oil film around the valve body in the broadened portion of the fine gap is cut, and the operational response property of the valve body is enhanced while the sticking phenomenon of the valve body by the oil film is prevented;

In the gas compressor having the biasing means according to the present invention, the valve body is forcibly separated from the truncated conical hole by the biasing force of the biasing means. Thus, the sticking phenomenon of the valve body by the oil film is prevented and the operational response property of the valve body is enhanced.

Furthermore, in the gas compressor having both the broadening means and the biasing means according to the present invention, it is possible to positively prevent the sticking phenomenon of the valve body by the oil film by means of the oil film cutting effect by such a broadening means and the separation effect of the valve body by the biasing means.

BRIEF DESCRIPTION OF THE DRAWINGS

FIG. 1A is a cross-sectional view of a pressure adjuster valve mounted on a gas compressor, and FIG. 1B is a cross-sectional view taken along the line 1B—1B of FIG. 1A.

FIG. 2A is a cross-sectional view of a pressure adjuster valve mounted on a gas compressor, and FIG. 2B is a cross-sectional view taken along the line 2B—2B of FIG. 2A.

FIG. 3A is a cross-sectional view of a pressure adjuster valve mounted on a gas compressor, and FIG. 3B is a cross-sectional view taken along the line 3B—3B of FIG. 3A.

FIG. 4A is a cross-sectional view of a pressure adjuster valve mounted on a gas compressor, and FIG. 4B is a cross-sectional view taken along the line 4B—4B of FIG. 4A.

FIG. 5A shows an opening operational condition of the pressure adjuster valve mounted on the gas compressor, and FIG. 5B shows a closing operational condition of the pressure adjuster valve.

DETAILED DESCRIPTION OF THE PREFERRED EMBODIMENT

Embodiments of a pressure adjuster valve and a gas compressor according to the present invention will now be described in detail with reference to FIGS. 1 to 7.

Figure 6:
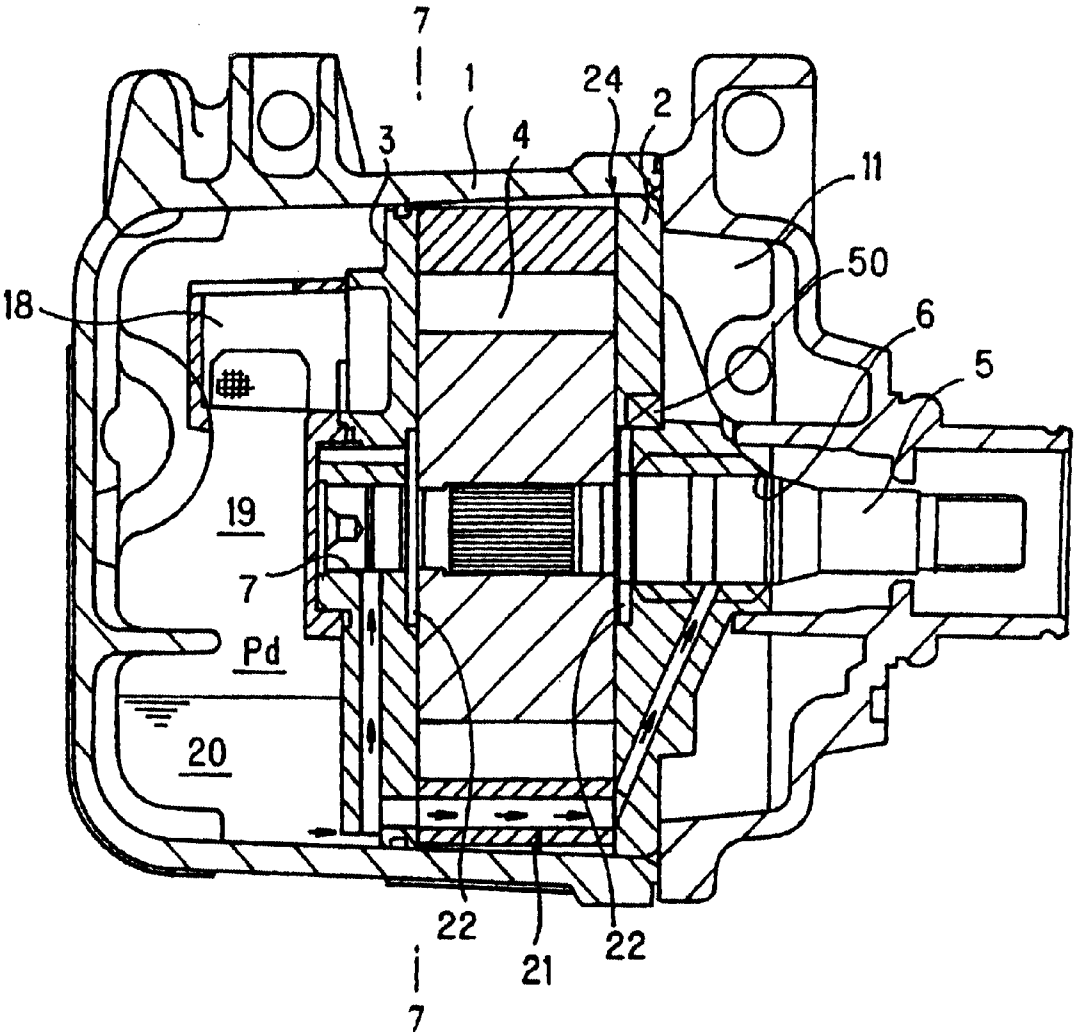
FIG. 6 is a schematic explanatory view of a basic structure of a vane rotary type gas compressor and a pressure adjuster valve incorporated therein.

A basic structure of the gas compressor according to this embodiment is shown in FIG. 6 in which the gas compressor has a substantially oval-shaped inner circumferential cylinder 1, and side blocks 2 and 3 are mounted at both end faces of the cylinder 1, respectively. A rotor 4 is disposed on the inside of the cylinder 1 thus arranged between the pair of right and left side blocks 2 and 3. The rotor 4 is laterally supported to be rotatable through a rotor shaft 5 provided integrally with an axis thereof and bearings 6 and 7 of the two side blocks 2 and 3 for supporting this.

Figure 7:
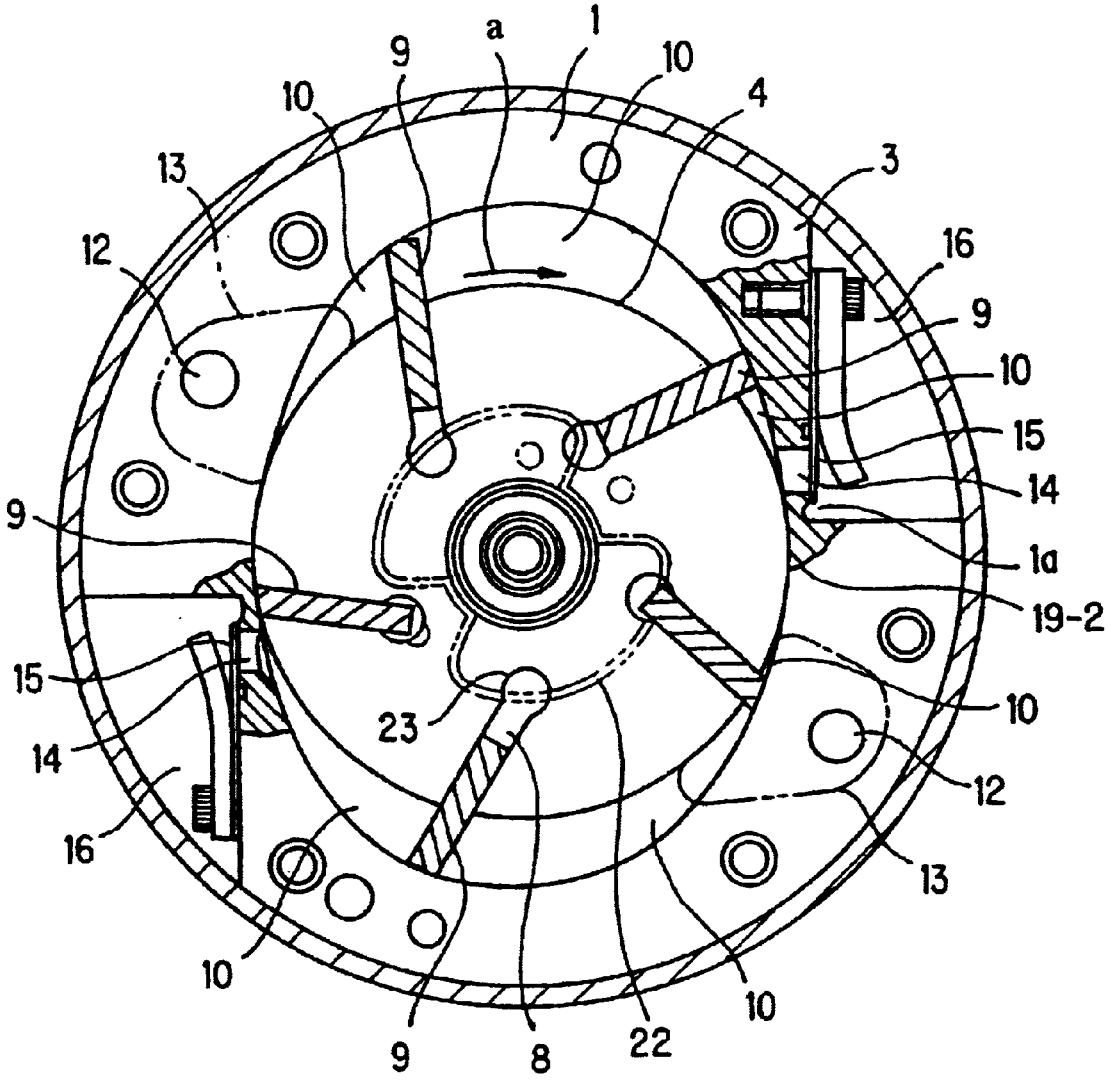
FIG. 7 is a cross-sectional view taken along the line 7—7 of FIG. 6.

As shown in FIG. 7, a plurality of slit-like vane grooves 8 extending in the radial direction are formed in the rotor 4. Vanes 9 are mounted one by one in the respective vane grooves 8. These vanes 9 are adapted to be projectable and retractable toward an inner wall of the cylinder 1 from an outer circumferential surface of the rotor 4, respectively.

The inside of the cylinder 1 is partitioned into a plurality of small chambers by the inner wall of the cylinder 1, the inner surfaces of the side blocks 2 and 3, the outer circumferential surface of the rotor 4 and both side surfaces at tip ends of the vanes 9. These partitioned small chambers are compression chambers 10, and by the rotation of the rotor 4 in the direction indicated by an arrow a in the drawing, it repeats the change in magnitude of volume.

When the volume change of the compression chamber 10 takes place, upon the volume increasing stage, the low pressure refrigerant gas within a suction chamber 11 formed upper flow side of the compression chamber 10 is sucked to the compression chamber 10 through suction passages 12 of the cylinder 1 or the like and suction ports 13 of the side blocks 2 and 3. Then, when the volume of the compression chamber 10 is started to decrease, the refrigerant gas within the compression chamber 10 is started to be compressed by the volume decreasing effect. Thereafter, when the volume of the compression chamber 10 approaches the minimum level, a reed valve 15 of a cylinder discharge port 14 located in the vicinity of a short oblong diameter portion of the cylinder 1 is opened by the pressure of the compressed high pressure refrigerant gas. Thus, the high pressure refrigerant gas within the compression chamber 10 is discharged from the discharge port 14 of the cylinder to a discharge chamber 16 in the external space of the cylinder 1 and further introduced from the discharge chamber 16 to the side of a discharge chamber 19 through an oil separator 18 or the like.

Lubricant oil is contained in the form of mist in the high pressure refrigerant gas discharged into the discharge chamber 16. The lubricant oil component contained in the high pressure refrigerant gas is separated upon passing through the oil separator 18 and is dropped and reserved in an oil sump 20 at the bottom portion of the discharge chamber 19.

The pressure of the high pressure refrigerant gas discharged into the discharge chamber 19 works on the oil sump 20. The oil of the oil sump 20 to which the discharge pressure Pd is thus applied passes through the oil flow path, i.e., the side blocks 2 and 3, an oil hole 21 of the cylinder 1, and the clearances of the bearings 6 and 7 in this order and is finally pressurized and fed to a back pressure chamber 23 in communication with the bottom portion of the vanes 9. Note that, the back pressure chamber 23 is composed of supply grooves 22 formed in opposite surfaces of the cylinder of the side blocks 2 and 3 and the space of the bottom portions of the vanes 9 connected to the supply grooves. Then, the pressure of oil pressurized and fed to the back pressure chamber 23 works on the vane 9 as the force (back pressure) for pushing the vane 9 upwardly to the inner wall of the cylinder 1.

Figure 1A:
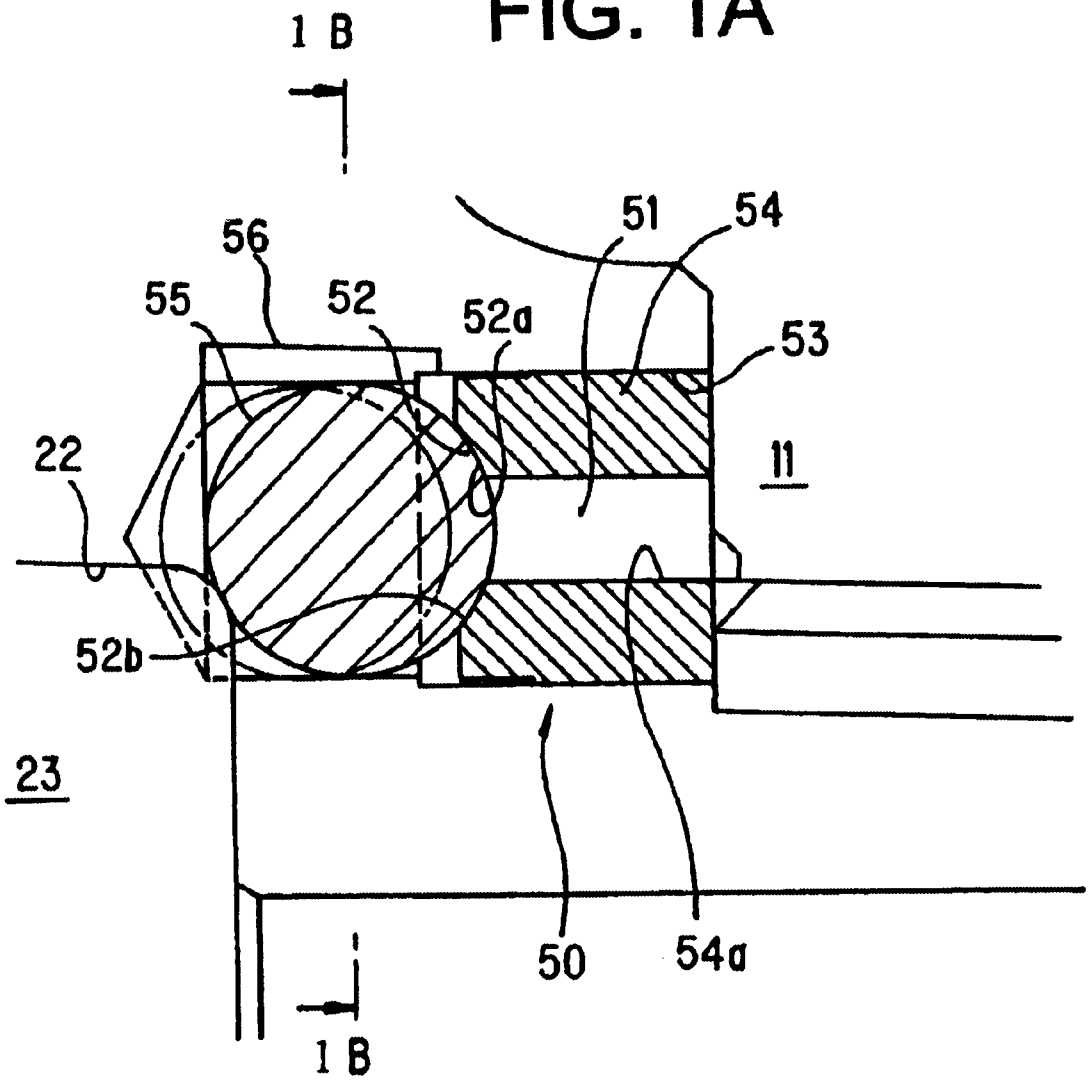
FIGS. 1A and 1B are explanatory views showing one embodiment of a primary part of the present invention, where
Figure 1B:
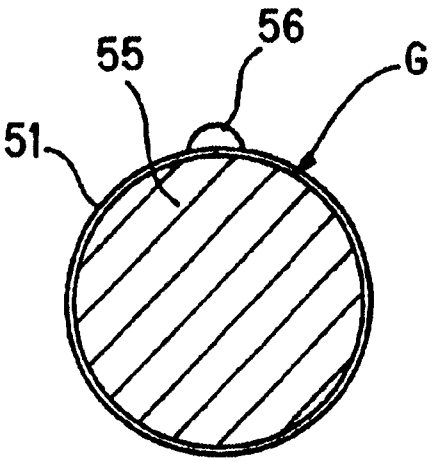

In the gas compressor according to this embodiment, a pressure adjuster 50 shown in FIG. 1 is incorporated as the means for causing the suction pressure and the back pressure chamber pressure of the refrigerant gas to be equal to each other when the pressures are reversed.

The pressure adjuster valve 50 of FIG. 1 has a communication passage 51 for connecting the suction chamber 11 and the back pressure chamber 23. A truncated conical hole 52 is provided as a valve seat portion on the way of the communication passage 51. This truncated conical hole 52 is in communication with the suction chamber 11 side at a small diameter opening end 52*a* on the apex portion of the truncated conical portion out of the two opening ends, and at the same time, a large diameter opening end 52*b* on the bottom portion of the truncated conical portion is opened and formed in communication with the back pressure chamber 23.

There are a variety of possible approaches for the method for forming the communication passage 51. In the pressure adjuster valve 50 according to this embodiment, a casing in the form of a cylindrical body or bush 54 having a short length corresponding to about half the length of a through hole 53 is disposed in the through hole 53 for connecting the suction chamber 11 and the back pressure chamber 23 with each other. The communication passage 51 is composed of a cylindrical hollow hole 54*a* of this cylindrical bush 54 and a front portion of the through hole 51 from the cylindrical bush 54. Also, in this case, the opening end of the cylindrical bush 54 is adapted to be opened in a conical shape to form the truncated conical hole 52.

A valve body 55 made of steel in the form of a ball is arranged within the communication passage 51. This valve body 55 is disposed to be movable along the communication passage 51, and at the same time formed to be engageable with the above-described truncated conical hole 52. Note that, the valve body 55 is located on the side of the opening end 52*b* having the larger diameter out of the two opening ends 52*a* and 52*b* of the truncated conical hole 52 and is adapted to be engageable with the hole 52 from this position.

A fine gap G that is necessary but at minimum to make it possible to move the valve body 55 is formed between the valve body 55 and the communication passage 51. In the pressure adjuster 50 according to this embodiment, a groove 56 is formed in an inner wall of the communication passage 50, more specifically, the inner surface of the front portion of the through hole 53 on the front side from the cylindrical bush 54 as the means for partially broadening this fine gap G. The groove 56 of this communication passage inner wall is provided in the moving direction of the valve body 55 and functions as the means for cutting the oil film to be formed around the valve body 55.

That is, also in the gas compressor in accordance with the embodiment, if the oil for lubricating the interior of the compressor for lubrication during the operation of the compressor is left within the communication passage 51 even after the standstill of the compressor, the oil film is formed around the valve body 55 within the communication passage 51. The means for providing the groove 56 in the inner wall of the communication passage 51 as the means for cutting the continuity of such an oil film is the pressure adjuster valve 50 according to the embodiment. In case of the pressure adjuster valve 50 according to this embodiment, the continuity of the oil film around the valve body 55 is cut so that the sealability between the valve body 55 and the communication passage 51 by this kind of oil film is considerably reduced in the forming portion of the groove 56 in the inner wall of the communication passage.

If the groove 56 of the above-described communication passage inner wall is formed at any part out of the overall portions of the fine gap G between such a valve body 55 and the communication passage 51, it is possible to expect the cutting effect of the oil film by the groove 56. In the pressure adjuster valve 50 according to this embodiment, such a groove 56 of the communication passage inner wall is formed in particular in an upper portion out of the overall portions of the fine gap G. This is because the loss of the effect that the oil film by the groove 56 is cut is avoided as much as possible. That is, in view of the oil distribution condition of the fine gap G as a whole, the oil is likely to be left in the lower portion of the fine gap G by the gravitational weight. Accordingly, in the case where the groove 56 in the inner wall of the communication passage is provided in the lower portion of the fine gap G, the groove 56 is likely to be filled with the oil relatively earlier, the possibility that the cutting effect of the oil film by the groove 56 is lost is high. In contrast, in the case where the groove 56 in the inner wall of the communication passage is provided in the upper portion of the fine gap G, the oil hardly would be left in the groove 56 and the cutting effect of the oil film by the groove 56 may be expected forever.

The operation of the thus constructed gas compressor in accordance with this embodiment will now be described with reference to FIGS. 1 and 6.

As shown in FIG. 6, also in the gas compressor according to this embodiment, when the operation thereof is started, the low pressure refrigerant gas within the suction chamber 11 is compressed in the cylinder 1 and discharged to the side of the discharge chamber 19 as the high pressure refrigerant gas. For this reason, comparing the chamber pressures within the suction chamber 11 and the discharge chamber 19 during the operation, the chamber pressure within the suction chamber 11 is lower. During the maintenance of such a pressure relationship, the valve body 55 of the pressure adjuster valve 50 is pressed into the truncated conical hole 52 by the pressure difference between the two chambers 11 and 19. Thus, the communication passage 51 is brought into the closed condition. Accordingly, the pressure on the side of the back pressure chamber 23 is no longer leaked to the side of the suction chamber 11 through the communication passage 51.

Incidentally, in the gas compressor according to this embodiment, also, in the case where a vehicle is parked for a long period of time is at a standstill state under the sunshine in high summer and the like, the same phenomenon as that of the conventional case, i.e., the phenomenon that the chamber pressure within the suction chamber 11 is higher than the chamber pressure within the discharge chamber 19 or the back pressure 23 in communication with this, i.e., the so-called reverse phenomenon would take place.

When the above-described reverse phenomenon takes place, the valve body 55 of the pressure adjuster valve 50 shown in FIG. 1 is released and moved away from the truncated conical hole 52 opens the communication passage 51 by the pressure difference between the two chamber 11 and 23 upon the reversal. Thus, the pressure of the suction chamber 11 is applied to the side of the back pressure chamber 23 through the communication passage 51 to cause the chamber pressures of the two chambers to be equal to each other.

The oil for lubricating the interior of the compressor for lubrication upon the operation of the compressor might be left within the communication passage 51 of the pressure adjuster valve 50 even after the standstill of the compressor but the phenomenon that the communication passage 51 is closed by the oil film of the left oil hardly would occur. This is because the groove 56 of the inner wall of the communication passage 51 becomes a flow path for the oil so that the oil is likely to flow out from the communication passage 51.

In the case where the oil is left in the communication passage 51 as described above, the oil film is formed around the valve body 55 of the pressure adjuster valve 50 but the continuity of this kind of oil film is cut by the groove 56 in the inner wall of the communication passage. Thus, the operational response property of the valve body 55 is enhanced and at the same time, the sticking phenomenon of the valve body 55 by the oil film around the valve body 55 hardly would take place.

As described above, in the pressure adjuster valve 50 according to this embodiment and in the gas compressor using this, in the structure of the pressure adjuster valve 50 the broadening means of the groove 56 in the inner wall of the communication passage 51 broadens partially the fine gap G between the valve body 55 and the communication passage 51. For this reason, the continuity of the oil film around the valve body 55 in the broadened portion of the fine gap G, i.e., the portion where the groove 56 is formed in the inner wall of the communication passage so that the operational response property of the valve body 55 is enhanced. Accordingly, when the reverse phenomenon in chamber pressures takes place in the two chambers, i.e., the discharge chamber 19 or the back pressure chamber 23 in communication with this and the suction chamber 11, the valve body 55 sensitively responds to this so that the chamber pressures of the two chambers (the back pressure chamber 23 and the suction chamber 11) kept under the reverse condition may be caused to be equal to each other quickly and positively. Accordingly, the defect in the case where the compressor is restarted when the reverse phenomenon in chamber pressures takes place as described above, namely, the degradation of the compressor may effectively be prevented.

Figure 2A:
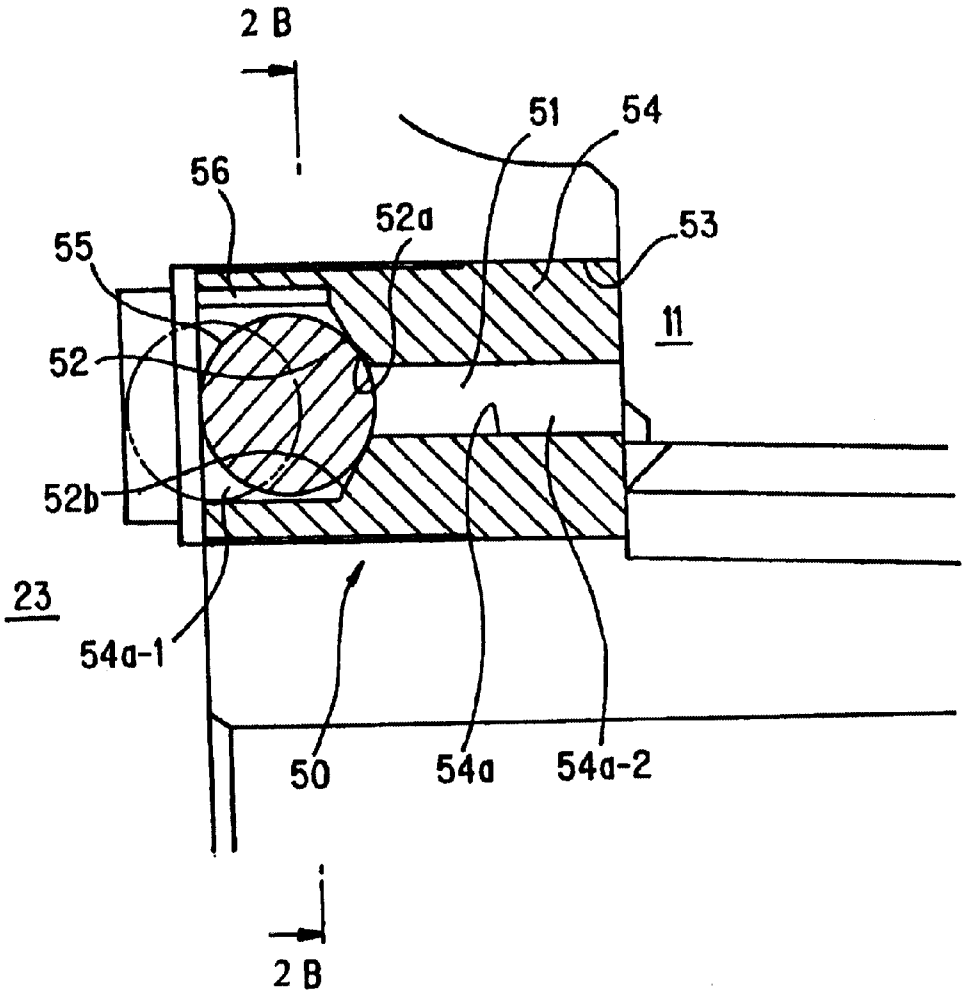
FIGS. 2A–2B are explanatory views showing another embodiment of a primary part of the present invention, where
Figure 2B:
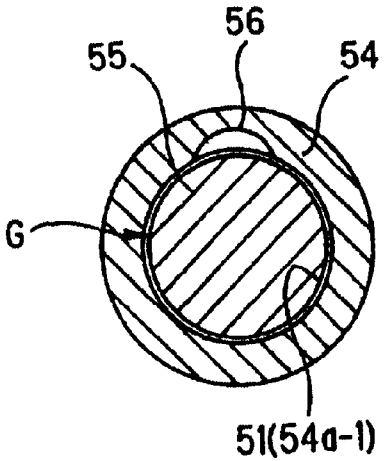

Note that, in the above-described embodiment, as shown in FIG. 1, a part of the communication passage 51 is formed of the cylindrical bush 54. However, as shown in FIG. 2, it is possible to form almost all the communication passage 51 by a cylindrical bush 54. Also in this case, the cylindrical bush 54 is arranged within the through hole 53. However, the cylindrical bush 54 used here is that a large diameter 54*a*-1 is applied to the midpoint of the cylindrical hollow hole 54*a* and a small diameter hole 54*a*-2 is applied to the front portion of the cylindrical hollow hole 54*a* onward therefrom. Then, in this case, the truncated conical hole 52 is formed in the bottom portion of the large diameter hole 54*a*-1. Also, the valve body 55 is provided movably within the large diameter hole 54*a*-1. The groove 56 of the inner wall of the communication passage is formed in the inner wall of the large diameter hole 54*a*-1.

In the case where the cylindrical bush 54 having the structure shown in FIG. 2 is used, it is possible to obtain the pressure adjuster valve 50 that operates more positively. This is because not only may the truncated conical hole 52 be formed within the cylindrical bush 54 but also the cylindrical surface for holding the valve body 55 movably is formed within the cylindrical bush 54 as the large diameter hole 54*a*-1 whereby it is possible to machine simultaneously the conical hole 52 and the large diameter hole 54*a*-1 to enhance the coaxility of the two components.

Figure 3A:
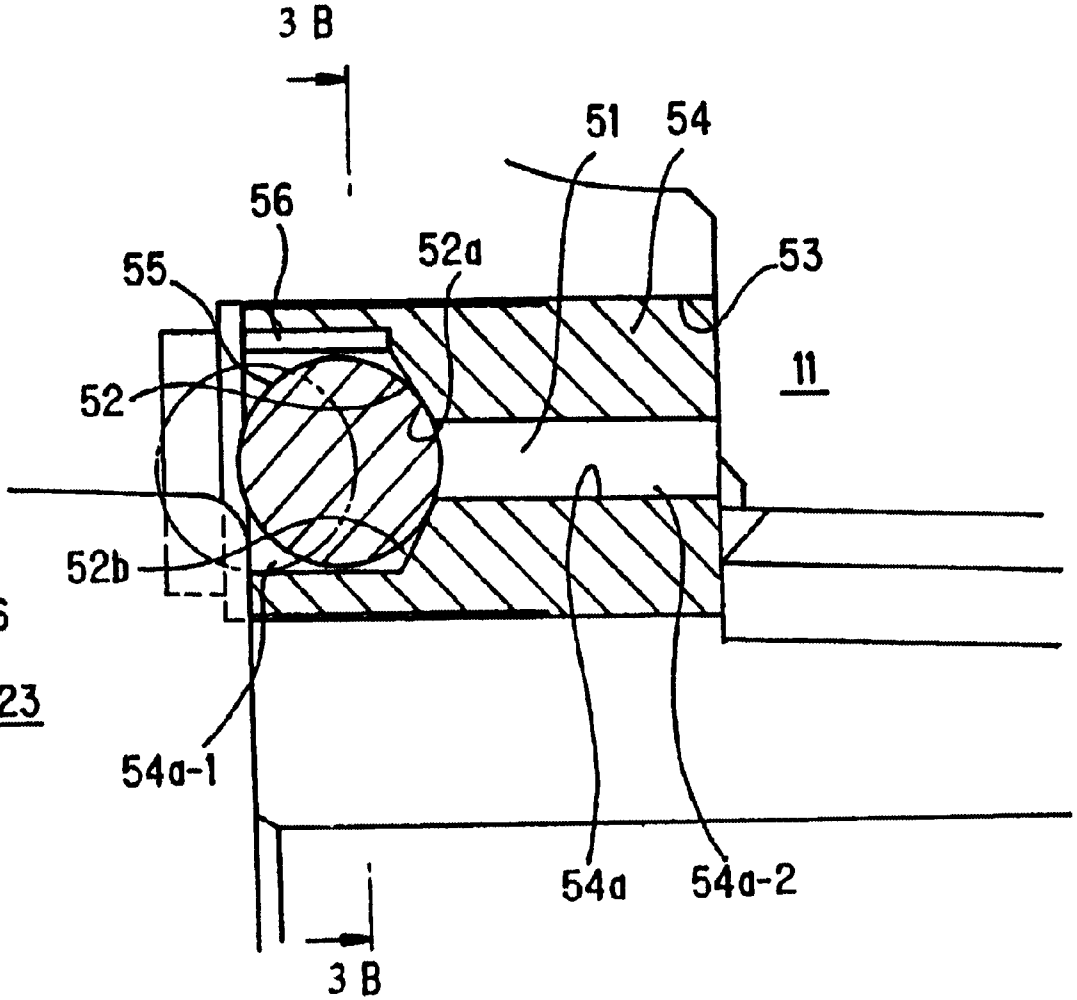
FIGS. 3A–3B are explanatory views showing another embodiment of a primary part of the present invention, where
Figure 3B:
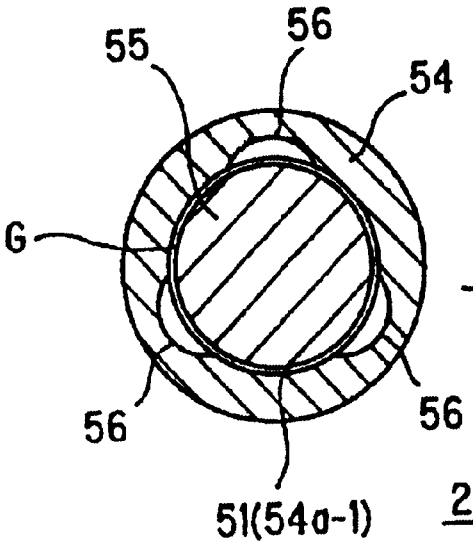

In the above-described embodiment, the single groove 56 is formed in the inner wall of the communication passage 51 as the means for partially broadening the fine gap G. However, it is possible to form a plurality of such grooves 56 radially in the inner wall of the communication passage 51 as the means for broadening the fine gap G at several positions as shown in FIG. 3.

In the case where only one groove 56 of the inner wall of the communication passage 51 is used as shown in FIG. 1, in view of the effective exhibition of the effect for cutting the oil film by the groove 56, it is necessary to set the groove 56 to be correctly disposed on the upper portion of the fine gap G. However, in the case where the plurality of grooves 56 of the inner wall of the communication passage 51 are provided radially as shown in FIG. 3, any one of the grooves 56 is disposed in the vicinity of the upper side portion of the fine gap G. Accordingly, it is possible to ensure the stable function without necessity to exactly control the orientation of the grooves 56, i.e., to obtain the function of cutting the oil film.

Figure 4A:
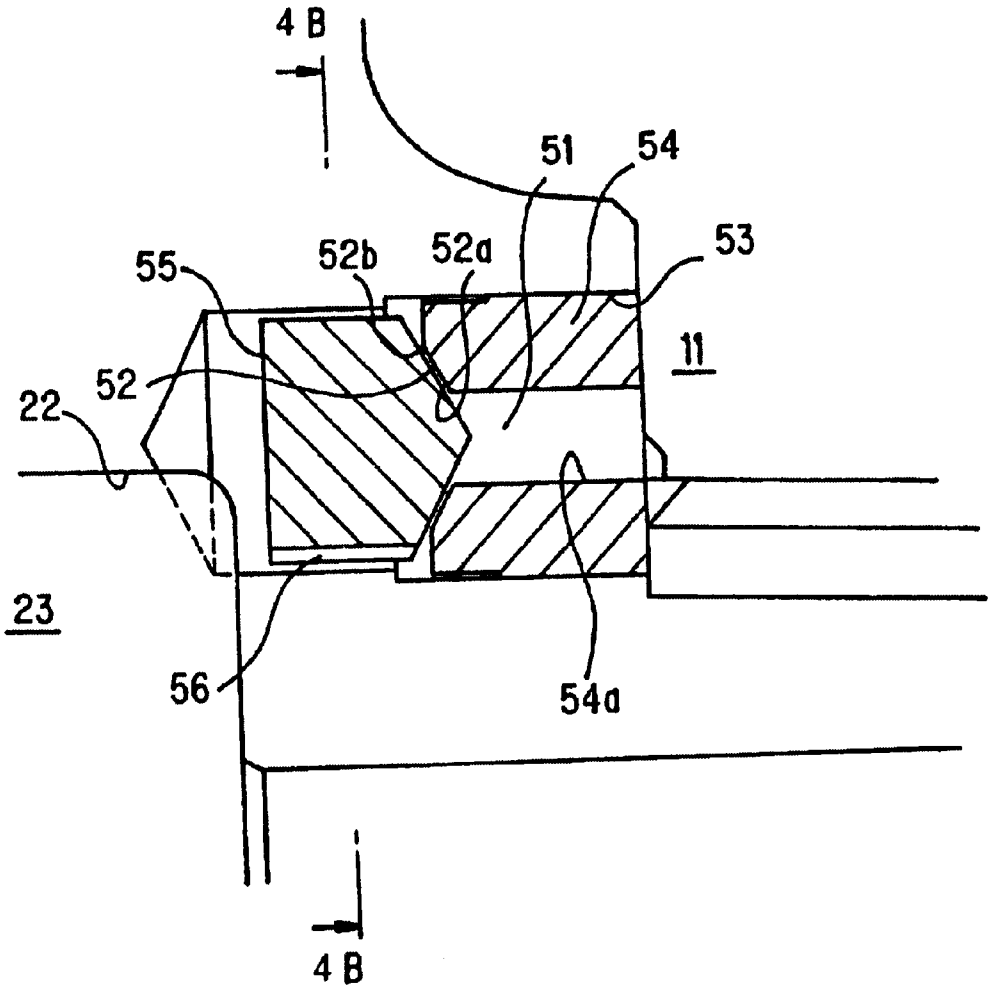
FIGS. 4A–4B are explanatory views showing another embodiment of a primary part of the present invention, where
Figure 4B:
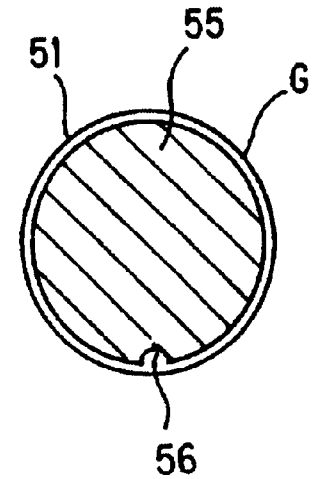

Also, in the above-described embodiment, the valve body 55 of the steel ball shape is used. However, instead thereof, it is possible to use the valve body 55 having a shape as shown in FIG. 4. The valve body 55 shown in the drawing has a shape provided at its tip end with a conical seal surface. In the case where the valve body 55 having such a conical seal surface is used, not only may the groove 56 as the broadening means be formed in the inner wall of the communication passage 51 but also the groove may be formed in the outer circumferential surface side of the valve body 55 as shown in the drawing. With such an arrangement, it is possible to broaden a width of the fine gap G by the groove 56 on the outer circumferential side of the valve body 55 to ensure the same effect as that described above. In addition, there is no formation of burr that is likely to occur in groove machining in the hole. It is therefore possible to dispense with the foreign matter administration of the burr or the like.

In any of the above-described embodiments, in order to prevent the bonding (sticking) phenomenon of the valve body 55 or the closing phenomenon of the communication passage 51 by the oil film, the structure for cutting the oil film around the valve body 55 by the groove 56 (broadening means) is adopted (See FIG. 1 or the like). It is however possible to use the structure as shown in, for example, FIG. 5 as the means for preventing this kind of sticking phenomenon in addition to the above-described embodiments. The difference between the pressure adjuster valve 50 shown in FIG. 5 and that shown in FIG. 1 or the like is that a coil spring 58 is provided as a biasing means within the communication passage 51. This coil spring 58 is disposed within the communication passage 51 and the valve body 55 is normally biased in a direction away from the truncated conical hole 52 (also referred to as the direction in which the communication passage 51 is opened). Also, the biasing force of the coil spring 58 is adapted to be greater than the sticking force of the oil film for sticking the valve body 55 to the truncated conical hole 52.

Figure 5B:
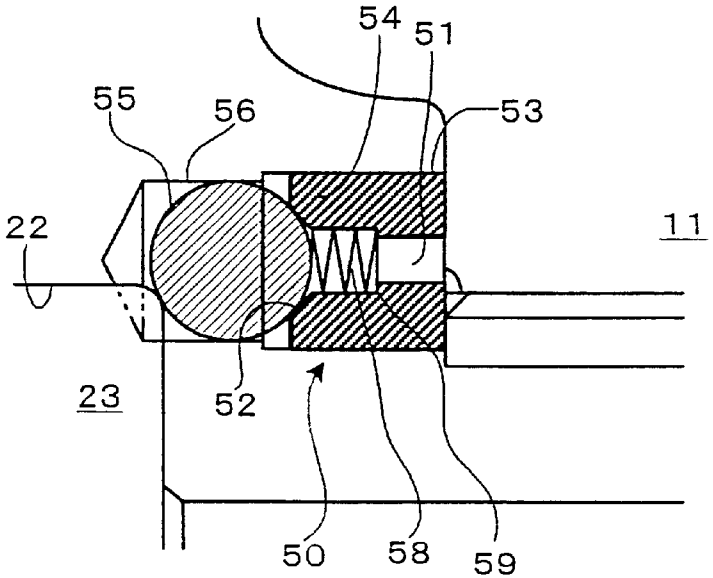
FIGS. 5A–5B are explanatory views showing another embodiment of a primary part of the present invention, where
Figure 5A:
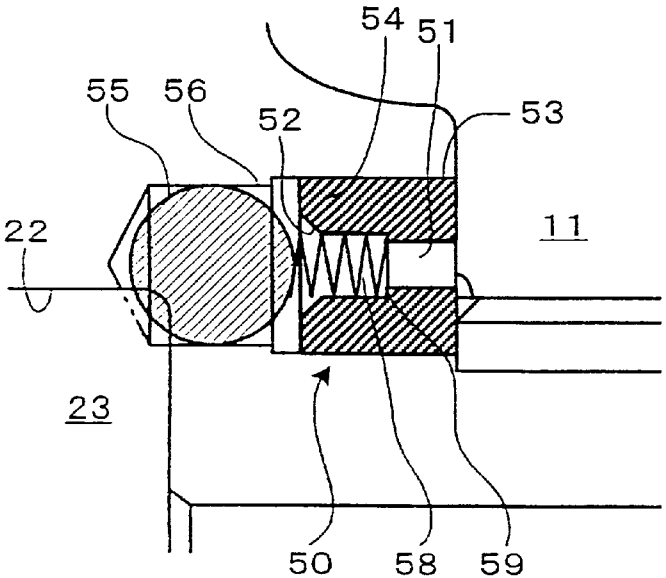

In the case of the pressure adjuster valve 50 shown in FIG. 5 provided with such a coil spring 58, when the chamber pressure within the suction chamber 11 is lower than the chamber pressure within the back pressure chamber 23, as shown in FIG. 5B, the valve body 55 is pressed into the truncated conical hole 52 against the biasing force of the coil spring 58 by the pressure difference between the two chambers 11 and 23 to close the communication passage 51. When the chamber pressures of the two chambers 11 and 23 are reversed, as shown in FIG. 5A, the valve body 55 is released and moved away from the truncated conical hole 52 to close the communication passage 51 by the biasing force of the coil spring 58 and the pressure difference between the two chambers 11 and 23 upon the reversal.

Also, in case of the pressure adjuster valve 50 of FIG. 5, when the chamber pressures of the back pressure chamber 23 and the suction chamber 11 are under the equilibrium, the valve body 55 is separated from the truncated conical hole 52 overcoming the sticking force of the oil film by the biasing force of the coil spring 58. For this reason, under such an equilibrium condition, it is possible to effectively prevent the phenomenon that the valve body 55 is stuck to the truncated conical hole 52 by the oil film. Accordingly, in the pressure adjuster valve 50 in the drawing, when the chamber pressure of the suction chamber is even slightly higher than that of the back pressure chamber 23, the valve body 55 may sensitively respond to such a slight pressure reverse phenomenon so that the chamber pressures of the two chambers 23 and 11 may be caused to be equal immediately.

Note that, the pressure control valve according to the above-described embodiments is provided with any one of the broadening means (groove 56) and the biasing means (coil spring 58). However, it is possible to modify such a pressure adjuster valve so as to have both of the broadening means and the biasing means.

Also, in the foregoing embodiment, the coil spring 58 is used as the biasing means. However, such biasing means is not limited thereto or thereby. It is possible to adapt any elastic member having the same function as the coil spring.

The pressure adjuster valve according to the present invention may be widely applied to equipment in which when the two chambers are reversed in chamber pressure, these pressures have to be equalized to each other positively and quickly, in addition to the gas compressor according to the above-described embodiments.

According to the present invention, in view of the above-described structure of the pressure adjuster valve, the fine gap between the valve body and the communication passage is partially broadened by the broadening means. For this reason, the continuity of the oil film around the valve body is cut in the broadened portion of the fine gap and the operational response property of the valve body is enhanced. Accordingly, when the chamber pressures within the two chambers are reversed, the valve body sensitively responds to this. The reversed chamber pressures of the two chambers may be caused to be equal to each other quickly and positively.

Also, according to the present invention, in view of the structure of the pressure adjuster, the biasing means for normally biasing the valve body in a direction away from the truncated conical hole is provided. For this reason, when the chamber pressures of the two chambers are equal to each other, the valve body is forcibly separated from the truncated conical hole overcoming the sticking force of the oil film by the biasing force of the biasing means. Accordingly, the sticking phenomenon of the valve body by the oil film is prevented and the operational response property is enhanced in such an equilibrium condition.

What is claimed is:

1. A gas compressor comprising:

a pair of side blocks;

a cylindrical body disposed between the pair of side blocks;

a rotor rotatably supported in the cylindrical body through bearings mounted on the pair of side blocks;

a rotor shaft rotatably supported by the bearings;

a plurality of vanes provided to be projectable and retractable from an outer circumferential surface of the rotor toward an inner wall of the cylindrical body;

a compression chamber formed and partitioned by the cylindrical body, the pair of side blocks, the rotor and the vanes;

a suction chamber formed at an upper flow side of the compression chamber;

a back pressure chamber disposed in communication with bottom portions of the vanes; and a pressure adjuster valve comprised of a body having a communication passage for connecting the suction chamber in fluid communication with the back pressure chamber and a truncated conical-shaped valve seat portion disposed at one end of the communication passage, a valve element disposed within the communication passage to define a fine gap therebetween and movable within the communication passage to engage the valve seat portion of the body, and broadening means for partially broadening a width of the fine gap between the valve element and the communication passage;

wherein when a pressure within one of the suction chamber and the back pressure chamber is lower than a pressure within the other of the suction chamber and the back pressure chamber, the valve element is pressed into engagement with the valve seat portion of the body by means of a pressure difference between the suction chamber and the back pressure chamber to thereby close the communication passage, and when the pressure within the suction chamber and the back pressure chamber are reversed, the valve element is moved away from the valve seat portion of the body by means of a pressure difference between the suction chamber and the back pressure chamber to thereby open the communication passage and equalize the pressures in the suction chamber and the back pressure chamber.

2. A gas compressor comprising:

a pair of side blocks;

a cylindrical body disposed between the pair of side blocks;

a rotor rotatably supported in the cylindrical body through bearings mounted on the pair of side blocks;

a rotor shaft rotatably supported by the bearings;

a plurality of vanes provided to be projectable and retractable from an outer circumferential surface of the rotor toward an inner wall of the cylindrical body;

a compression chamber formed and partitioned by the cylindrical body, the pair of side blocks, the rotor and the vanes;

a suction chamber formed at an upper flow side of the compression chamber;

a back pressure chamber disposed in communication with bottom portions of the vanes; and a pressure adjuster valve comprised of a communication passage for connecting the suction chamber in fluid communication with the back pressure chamber and a truncated conical-shaped valve seat portion disposed at one end of the communication passage, a valve element disposed within the communication passage to define a fine gap therebetween and movable within the communication passage to engage the valve seat portion of the body, broadening means for partially broadening a width of the fine gap between the valve element and the communication passage, and biasing means for normally biasing the valve element in a direction away from the valve seat portion.

3. A gas compressor according to claims 1 or 2; wherein the broadening means comprises means for broadening an upper portion of the fine gap.

4. A gas compressor according to claims 1 or 2; wherein the broadening means comprises means for broadening the width of the fine gap at several positions around the valve element.

5. A gas compressor according to claims 1 or 2; wherein the broadening means comprises a groove formed in an inner wall of the communication passage along a moving direction of the valve element.

6. A gas compressor according to claims 1 or 2; wherein the broadening means comprises a groove formed in an outer surface of the valve element.

7. A gas compressor according to claim 2; wherein a biasing force of the biasing means is greater than a bonding force of oil film for bonding the valve element to the valve seat portion.

* * * * *